US010690327B2

(12) United States Patent
Blackwelder et al.

(10) Patent No.: US 10,690,327 B2
(45) Date of Patent: Jun. 23, 2020

(54) FOLDING LIGHT TOWER

(71) Applicants: Paul Bradford Blackwelder, Medina, OH (US); Andrew Paul Wasson, Wooster, OH (US)

(72) Inventors: Paul Bradford Blackwelder, Medina, OH (US); Andrew Paul Wasson, Wooster, OH (US)

(73) Assignee: The Will-Burt Company, Orrville, OH (US)

( * ) Notice: Subject to any disclaimer, the term of this patent is extended or adjusted under 35 U.S.C. 154(b) by 0 days.

(21) Appl. No.: 16/191,896

(22) Filed: Nov. 15, 2018

(65) Prior Publication Data

US 2019/0145613 A1 May 16, 2019

Related U.S. Application Data

(60) Provisional application No. 62/586,941, filed on Nov. 16, 2017.

(51) Int. Cl.

| | |
|---|---|
| ***F21V 21/26*** | (2006.01) |
| ***E04H 12/18*** | (2006.01) |
| ***F21V 21/30*** | (2006.01) |
| ***F21S 2/00*** | (2016.01) |
| *F21W 131/10* | (2006.01) |
| *F21V 21/116* | (2006.01) |
| *F21V 21/108* | (2006.01) |

(52) U.S. Cl.

CPC ..... *F21V 21/26* (2013.01); *E04H 12/187* (2013.01); *F21S 2/00* (2013.01); *F21V 21/30* (2013.01); *F21V 21/108* (2013.01); *F21V 21/116* (2013.01); *F21W 2131/1005* (2013.01)

(58) Field of Classification Search

CPC ..... F21V 21/26; F21V 21/30; E04H 12/187; F21S 2/00

See application file for complete search history.

(56) References Cited

U.S. PATENT DOCUMENTS

| | | | | |
|---|---|---|---|---|
| 2015/0023017 | A1 | 1/2015 | Smith et al. | |
| 2015/0092430 | A1* | 4/2015 | Hannah | F21L 14/04 362/427 |
| 2016/0002946 | A1* | 1/2016 | Wijning | E04B 1/19 52/116 |
| 2016/0375281 | A1 | 12/2016 | Vetesnik | |

FOREIGN PATENT DOCUMENTS

| | | | |
|---|---|---|---|
| AU | 8938901 | A * | 5/2002 |
| AU | 200189389 | A * | 5/2002 |
| AU | 200189389 | A1 | 5/2002 |

OTHER PUBLICATIONS

International Search Report dated Aug. 4, 2019 for International Application No. PCT/US2018/061323.

* cited by examiner

*Primary Examiner* — Isiaka O Akanbi
*Assistant Examiner* — Nathaniel J Lee
(74) *Attorney, Agent, or Firm* — Fay Sharpe LLP

(57) ABSTRACT

A folding light tower is provided that utilizes a 4-bar linkage mechanism which enables full vertical extension of the tower with the use of one actuator. The exemplary tower generally includes a base, a lower lift arm, and an upper lift arm. Spring elements are used near the rotating joints of the lower lift arm and upper lift arm of the tower. The spring elements act to preload the joints and help to remove play and movement when the tower is unfolded/during the vertical extension process.

16 Claims, 12 Drawing Sheets

VIEW A-A
SCALE .125

DETAIL A

DETAIL A
(FROM FIG. 3B)

FOLDING LIGHT TOWER

CROSS-REFERENCE TO RELATED APPLICATION

This application claims the benefit of U.S. Provisional Application No. 62/586,941, filed Nov. 16, 2017, incorporated herein by reference in its entirety.

BACKGROUND

The present exemplary embodiment relates to vertically extendable mechanisms. It finds particular application in conjunction with portable or stationary folding towers for various types of light sources and will be described with particular reference thereto. However, it is to be appreciated that the present exemplary embodiment is also amenable to other like applications, such as for antennas, surveillance equipment, and other payloads.

Light towers provide scene lighting solutions in various settings, such as emergency recovery searches and operations, surveillance, or venue and job sites to improve night time operation productivity and ensure safety. Light towers have multiple options for mounting, including stationary ground-mounted towers or portable towers mounted on the side or roof of vehicles. Light towers can also include a number of different devices or sensors that may be required for various applications, such as security cameras, speaker systems, infrared detectors, etc. and the like.

However, existing extendable mechanisms for folding light towers are known to be complex and expensive, requiring the use of at least two actuators to achieve fully extended vertical configurations. Thus, it would be desirable to provide a folding light tower which offers less complexity, ease of manufacture, and less cost.

BRIEF DESCRIPTION

In accordance with one aspect of the disclosure, a folding tower light utilizes a 4-bar linkage mechanism to enable full vertical extension of the tower light with the use of one actuator. Spring elements are used to pre-load the hinges or joints of the tower and help to remove play and movement when the tower is unfolded/during the vertical extension process. The folding tower has a nested or retracted configuration that reasonably covers the existing foot print of typical extendable mechanism and has a fully extended vertical configuration that deploys faster than typical extendable mechanisms.

In accordance with another aspect of the disclosure, a folding tower system for use in raising a light source is disclosed. The folding tower system includes a stationary base having a first end and a second end, a lower lift arm having a first end and a second end, the first end of the lower lift arm being connected to the base, an actuator attached to the base and the lower lift arm, an upper lift arm having a first end and a second end, the first end being adapted to mount the light source thereon, and a 4-bar linkage mechanism connecting the second end of the lower lift arm to the second end of the upper lift arm in rotational relation to one another. In some embodiments, a pin assembly pivotally connects the stationary base and the lower lift arm and the other end of the actuator can be pivotally connected to the lower lift arm. An adjustment mechanism can be included which is adapted to adjust an angle of the actuator with respect to the base and the lower lift arm. The stationary base and the lower and upper lift arms can be disposed horizontally parallel to each other when in a retracted configuration. The lower and upper lift arms can be disposed vertically perpendicular to the base when in a vertical extended configuration. In addition, one or more support struts can be included that are rotationally connected to the base and the upper lift arm. The one or more support struts can comprise a first support strut and a second support strut disposed on opposite sides of the folding tower system. The first support strut can have a first ball joint rotationally connected to one side of the base and a second ball joint rotationally connected to one side of the upper lift arm on the 4-bar linkage mechanism. The second support strut can have a first ball joint rotationally connected to an opposite side of the base and a second ball joint rotationally connected to an opposite side of the upper lift arm on the 4-bar linkage mechanism. The 4-bar linkage mechanism can also comprise at least one lift link and a knuckle rotationally connected to the lower and upper lift arms. The knuckle further can include a first sidewall and a second sidewall connected by an upper bridge wall and a lower bridge wall. The upper and lower bridge walls are adapted to prevent an over-rotation of the folding tower system. One or more spring elements attached to the base can also be included which provide a pre-loaded joint between the base and the lower lift arm. In addition, one or more spring elements attached to the upper lift arm can be included which provide a pre-loaded joint between the upper lift arm and the 4-bar linkage mechanism. Further, a light box can be mounted to the upper lift arm. In some embodiments, a first support strut is rotationally connected to one side of the base and upper lift arm and a second support strut is rotationally connected to an opposite side of the base and upper lift arm. In some embodiments, the folding tower light system includes a mechanical cable, wherein one end of the mechanical cable is attached through pulleys to a second square tube telescoped inside the upper lift arm and the other end of the mechanical cable attached to the stationary base and wherein the second square tube is configured to extend as the 4-bar linkage mechanism pulls away from the base.

In accordance with another aspect of the present disclosure, a folding tower system for raising a light source is disclosed. The folding light tower system includes a stationary base having a first end and a second end and a lower lift arm having a first end and a second end, the first end of the lower lift arm being connected to the base. An actuator is attached to the base and the lower lift arm, wherein one end of the actuator is attached to the base and another end of the actuator is pivotally connected to the lower lift arm. The folding light tower system further includes an upper lift arm having a first end and a second end, the first end being adapted to mount the light source thereon and a 4-bar linkage mechanism connecting the second end of the lower lift arm to the second end of the upper lift arm in rotational relation to one another. An adjustment mechanism is adapted to adjust an angle of the actuator with respect to the base and the lower lift arm. At least two support struts are rotationally connected to the base and the upper lift arm, wherein the at least two support struts comprises a first support strut and a second support strut disposed on opposite sides of the folding tower system. One or more spring elements are attached to the upper lift arm to provide a pre-loaded joint between the upper lift arm and the 4-bar linkage mechanism.

In accordance with yet another aspect of the present disclosure, a process for raising a light source is disclosed which includes providing a folding tower system that has a stationary base, a lower lift arm, an actuator, an upper lift arm, a light box mounted to the upper lift arm, and a 4-bar linkage mechanism rotationally connecting the lower lift arm and the upper lift arm. A force is applied to the lower arm with the actuator. The lower arm is rotated into a vertical extended configuration with respect to the base. The upper lift arm is rotated into the vertical extended configuration with the 4-bar linkage mechanism. In some embodiments, the actuator applies a linear force to the lower lift arm and the rotating of the upper lift arm further includes translating the linear force into angular rotation. The lower and upper lift arms can be raised from a retracted configuration into the vertical extended configuration, wherein the base and the lower and upper lift arms are disposed horizontally parallel to each other when in the retracted configuration and wherein the lower and upper lift arms are disposed perpendicular to the base when in the vertical extended configuration.

DETAILED DESCRIPTION

Typical lift systems for folding tower lights rely on the use of two actuators to achieve full vertical extension of the tower light. In particular, a first actuator is used to raise a lift arm on which the light tree is attached. A second actuator is then used to raise the light tree.

In contrast, an exemplary folding tower light assembly in accordance with the present disclosure utilizes a 4-bar linkage mechanism which enables full vertical extension of a tower light with the use of one actuator. The exemplary tower generally includes a base, a lower lift arm, and an upper lift arm. Spring elements are used near the rotating joints of the lower lift arm and upper lift arm of the tower. The spring elements act to preload the joints and help to remove play and movement when the tower is unfolded/during the vertical extension process. The upper and lower lift arms can be hollow tubes providing internal passages for simplified internal wiring for the lights of the tower light. Additional structural support for the tower comes from two parallel, splayed supports or struts. Due to the non-orthogonal geometry of the splayed struts, the ends of each strut are provided with ball joints to enable movement of the tower during vertical extension.

As previously mentioned, it is preferred to utilize a 4-bar linkage mechanism to enable full vertical extension of the tower light. In the present disclosure, the 4-bar linkage mechanism is generally disposed between one end of each of the lower and upper lift arms. In a folded or retracted configuration, the base and lower and upper lift arms of the tower are disposed horizontally parallel to each other. The single actuator mechanism applies a linear force to the lower arm of the tower, and through the use of a pin assembly about which the lower lift arm can rotate with respect to the base, the linear motion of the actuator translates into angular rotational motion of the lower lift arm. The 4-bar linkage mechanism enables translation of the linear movement of the actuator piston into angular rotation of the upper lift arm about the 4-bar linkage. Generally, the lower and upper lift arms rotate from their horizontal position in the folded configuration to a fully extended vertical configuration. This process is reversed to return the lower and upper lift arms to their horizontal position in the folded configuration.

Figure 1A:
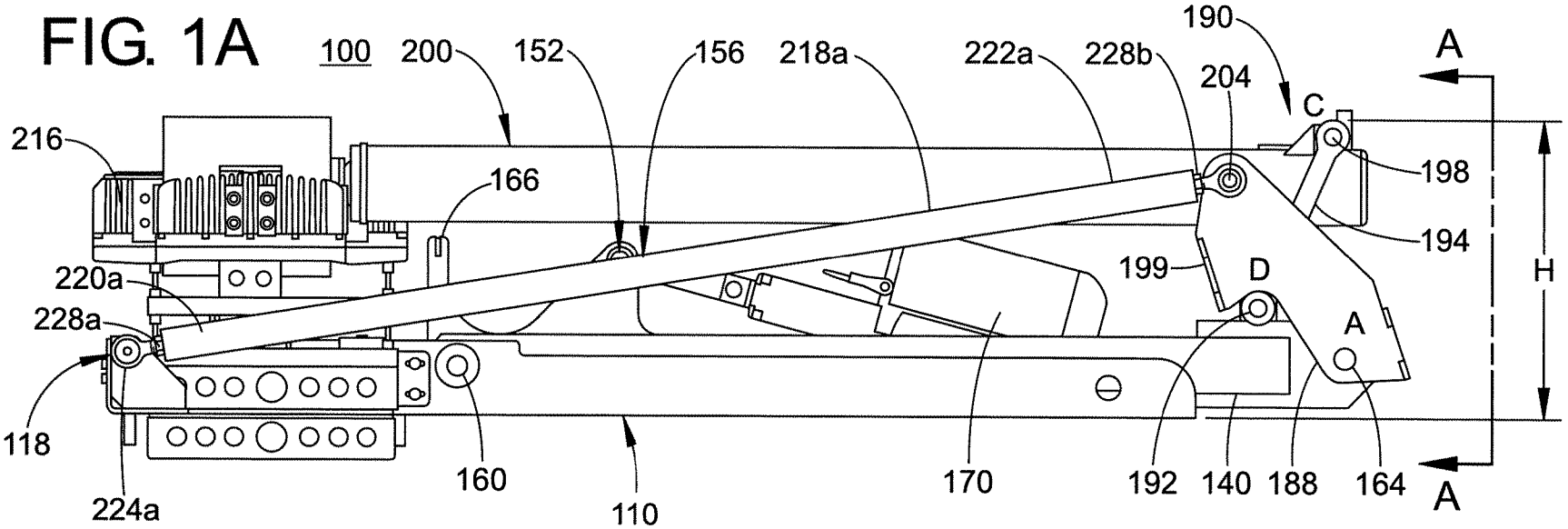
FIG. 1A is a side elevation view of an exemplary folding tower light assembly in a folded or retracted configuration and in accordance with the present disclosure.
Figure 1B:
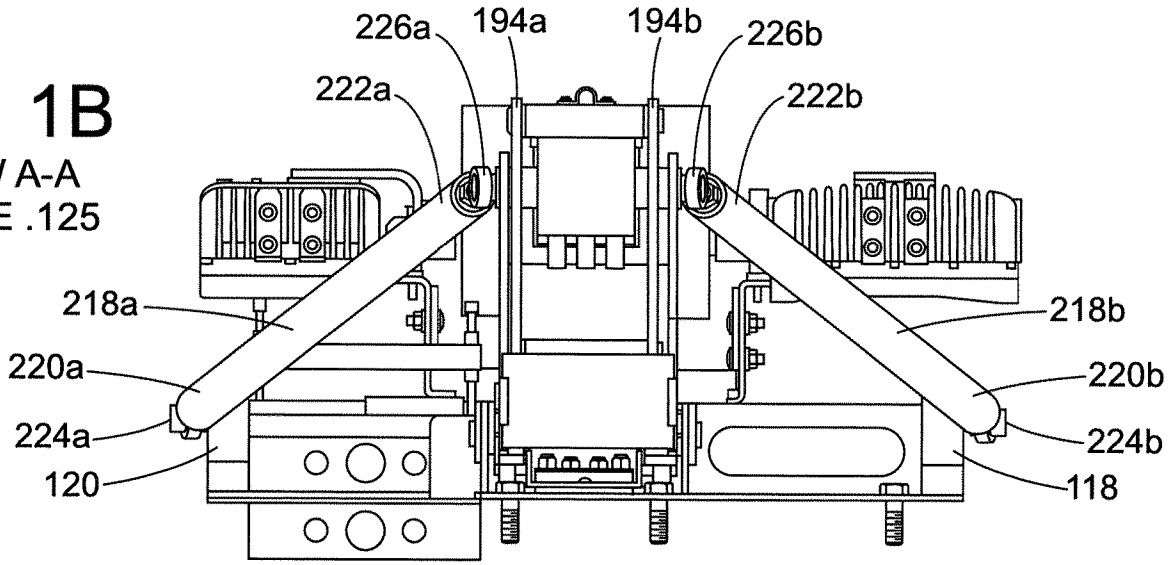
FIG. 1B is a rear elevation view of the exemplary folding tower light assembly of FIG. 1A.
Figure 1C:
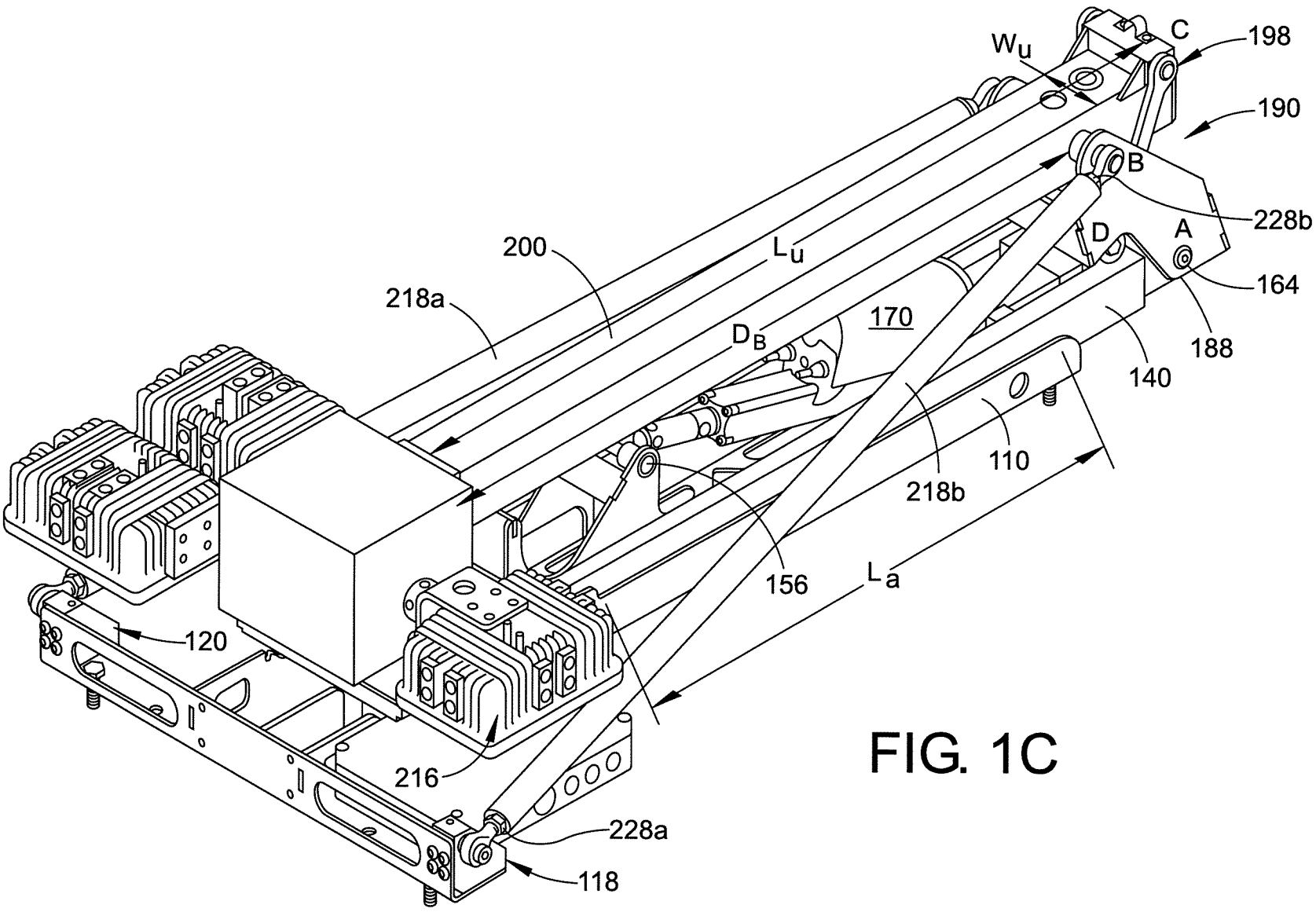
FIG. 1C is a perspective view of the of the exemplary folding tower light assembly of FIG. 1A.
Figure 5:
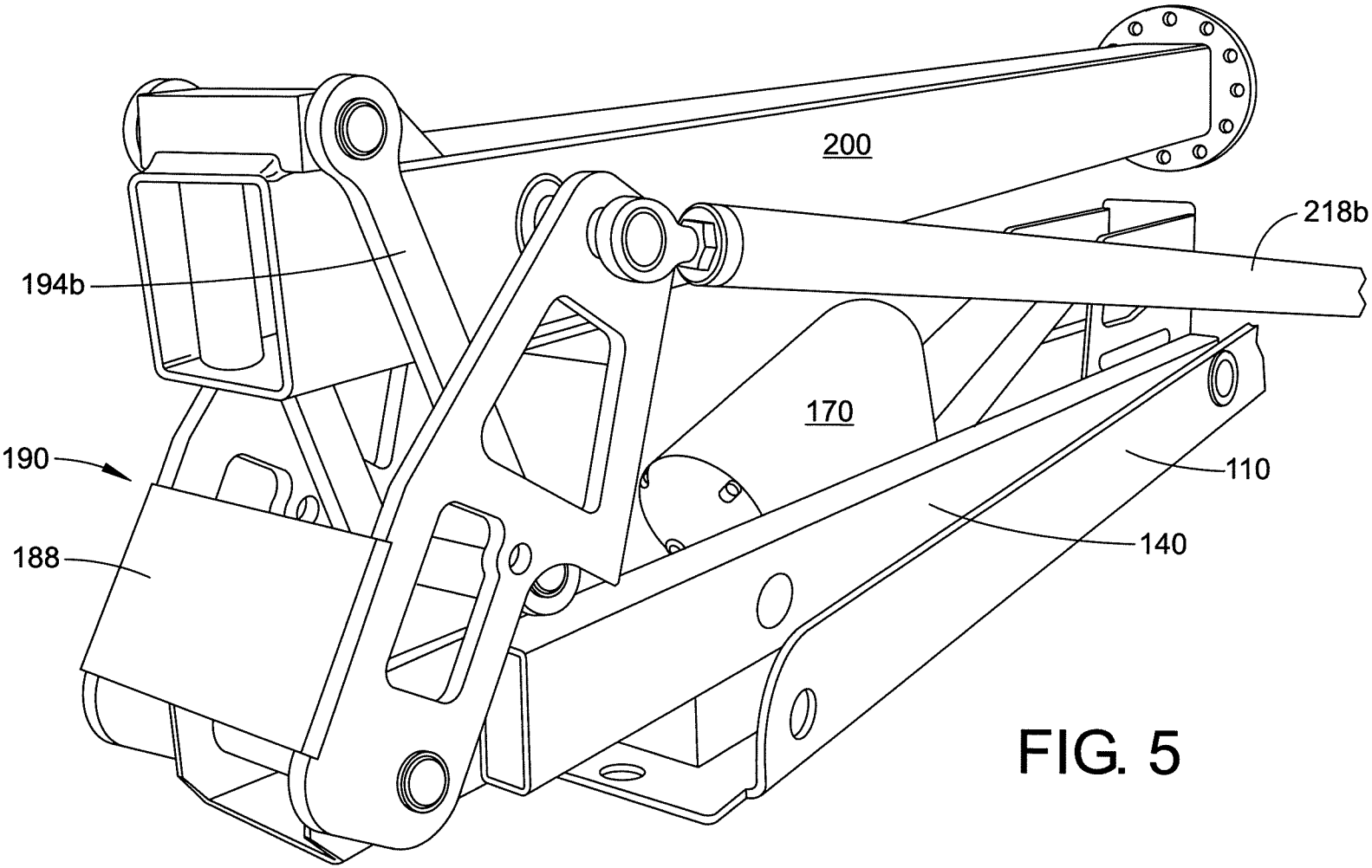
FIG. 5 is a perspective view of the exemplary folding tower light assembly and 4-bar linkage mechanism in a retracted configuration and in accordance with the present disclosure.

Turning now to FIGS. 1A-1C, an exemplary folding tower light 100 is illustrated in a folded or retracted configuration. FIG. 5 also shows the exemplary folding tower light in the retracted configuration. The main components of the folding tower light 100 generally include a base 110, a lower lift arm 140, a linear actuator 170, a 4-bar linkage mechanism 190, an upper lift arm 200, a light box 216 including one or more lights, and first and second parallel support struts 218*a* and 218*b*, respectively. The base 110 is generally stationary with respect to a mounting surface on which the base is attached or located, which may include the ground or a portable device such as a vehicle or trailer. The base 110 and lower lift arm 140 are generally pivotally connected to each other by a strut pin assembly 160. One end of the linear actuator 170 is attached to the base 110 and the other end of the actuator is pivotally connected to the lower lift arm 140. In particular, the actuator 170 is pivotally connected to the lower lift arm 140 via actuator pin assembly 156 at one end of a flange portion 152. The flange portion 152 generally extends upward from the lower lift arm 140 to receive and position the actuator 170 diagonally between the lower lift arm and base 110. Moreover, at the other end of the flange portion 152 and adjacent a foot portion 166 thereof, the lower lift arm 140 is pivotally connected to the base 110 via strut pin assembly 160. The lower lift arm 140 and the upper lift arm 200 are rotationally connected to each other by the 4-bar linkage mechanism 190.

Figure 2A:
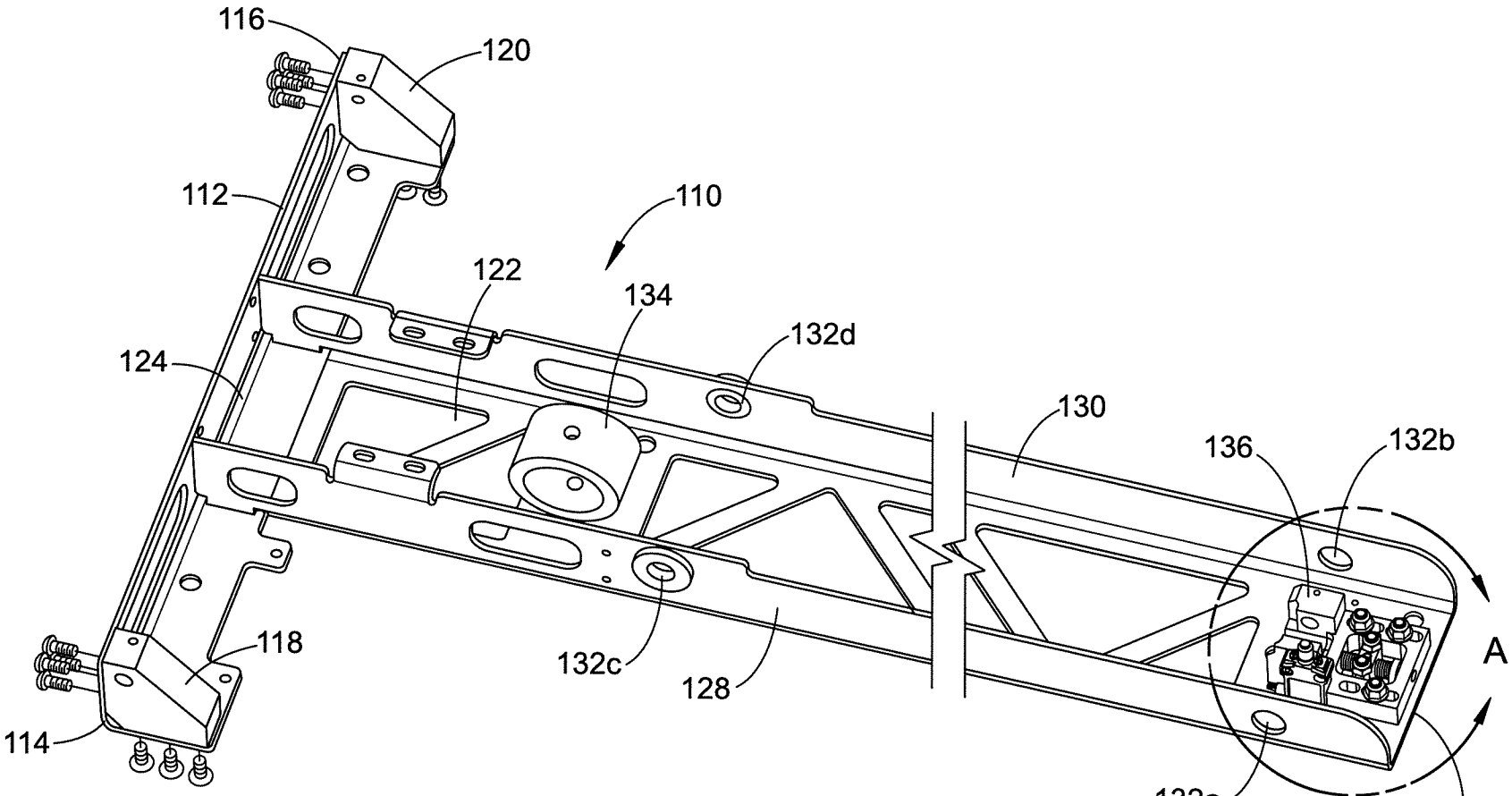
FIG. 2A is a perspective view of a base in accordance with the present disclosure.
Figure 2B:
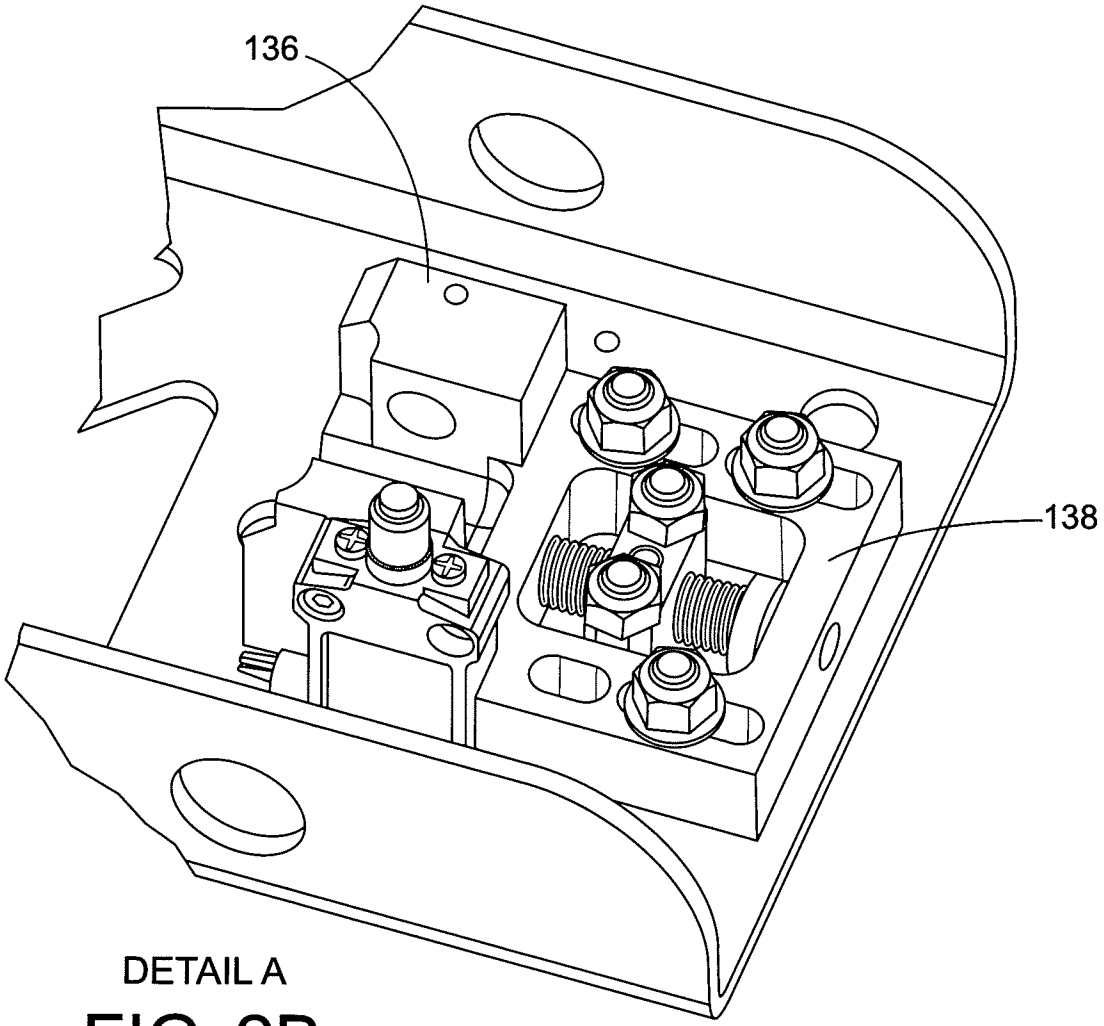
FIG. 2B is a perspective view of one end of the base illustrated in FIG. 2A showing additional detail of an associated pivot block and adjustment mechanism.
Figure 6B:
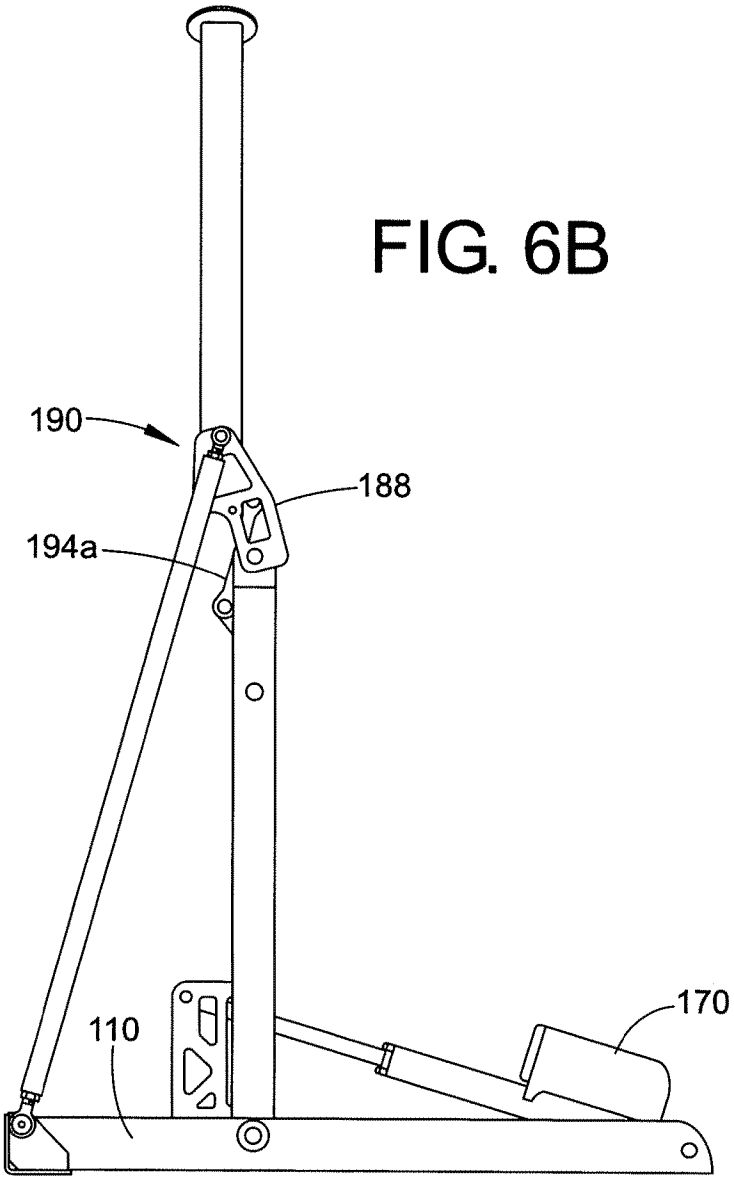
FIG. 6B is a side elevation view of the exemplary folding tower light assembly in the fully extended vertical configuration.
Figure 6A:
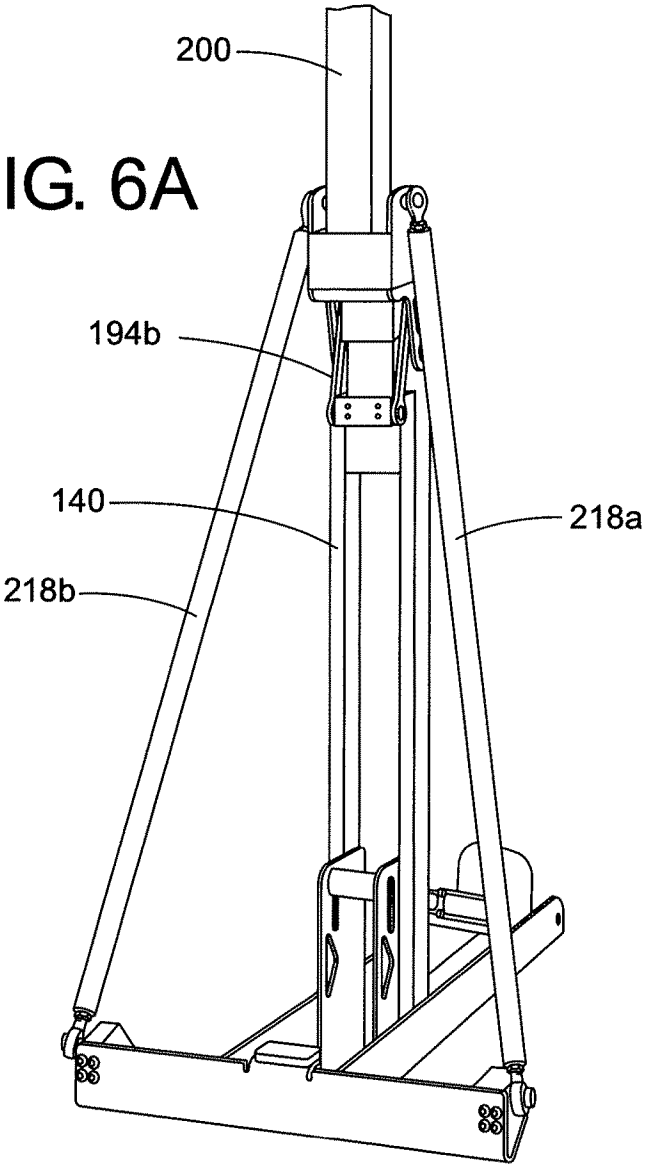
FIG. 6A is a perspective view of the exemplary folding tower light assembly in a fully extended vertical configuration in accordance with the present disclosure.

When in the retracted configuration, the base 110 and the lower and upper lift arms 140, 200 are disposed horizontally parallel to each other. The lower lift arm 140 is also generally located within a channel portion (122 in FIG. 2A) of the base 110. The actuator 170 is also generally disposed in an open middle section (150 in FIG. 3) of the lower lift arm 140. When in a vertical extended configuration, as shown in FIGS. 6A and 6B, the lower and upper lift arms 140, 200 are disposed vertically perpendicular to the base 110.

The 4-bar linkage mechanism is generally indicated by reference numeral 190 and is adapted to connect lower and upper lift arms 140, 200 in rotational relation to one another. As mentioned above, actuator 170 applies a linear force to the lower lift arm 140, and the 4-bar linkage 190 enables angular rotation of the upper lift arm 200 from the horizontal folded configuration to a vertical extended configuration. Moreover, when in the contracted configuration illustrated in FIGS. 1A-1C and shown in FIG. 5, the 4-bar linkage mechanism 190 defines a height H of the folded tower. The 4-bar linkage 190 comprises four main joints A, B, C, and D defined by lower strut pin assembly 164, upper strut pin assembly 204, upper link pin assembly 198, and lower link pin assembly 192, respectively. The pin assemblies 164, 204, 198, and 192 can further include various other components known to those having skill in art as being useful for creating rotatable joints or hinges, such as bushings, bearings, washers, retaining rings, etc. The lower and upper strut pin assemblies 164, 204 are linked via knuckle component 188, also shown as link AB. The knuckle component 188 includes two sidewalls (189 and 191 in FIG. 4) which enable the knuckle to fit over both the left and right side of the lower and upper lift arms 140, 200 such that an AB link is provided on both sides of the tower. The lower and upper link pin assemblies 192, 198 are linked via left and right side lift links 194*a*, 194*b*, such that link DC is provided on both sides of the tower.

The exemplary folding light further includes first and second parallel support struts 218*a* and 218*b* each located on one side of the tower. When in the folded configuration, the support struts 218*a* and 218*b* extend diagonally between the base 110 and the upper lift arm 200 and are rotationally connected thereto. The diagonal orientation of the support struts 218*a* and 218*b* is generally opposite to the diagonal orientation of the actuator 170. In addition, each support strut 218*a*, 218*b* splays outward from its respective connection point at the upper lift arm 200 to respective anchors 118, 120 located on the base 110. In particular, the first parallel strut 218*a* has a first end 220*a* and a second end 222*a*, each end including a respective ball joint 224*a* and 226*a*. Ball joint 224*a* rotationally attaches to second side anchor 120 and ball joint 226*a* rotationally attaches adjacent joint B to sidewall 191 (FIG. 4) of the knuckle 188. The second parallel strut 218*b* has a first end 220*b* and a second end 222*b*, each end including a respective ball joint 224*b* and 226*b*. Ball joint 224*b* rotationally attaches to first side anchor 118 and ball joint 226*b* rotationally attaches adjacent joint B to sidewall 193 (FIG. 4) of the knuckle 188. The support struts 218*a*, 218*b* add additional structural support to the folding tower when in the vertically extended configuration as shown in FIGS. 6A and 6B, in addition to enabling rotational movement despite the non-orthogonal orientation of the support struts.

Referring now to FIGS. 2A-2B and 3A-3C, additional features of the base 110 and lower lifting arm 140 of the exemplary folding light tower are illustrated. The base 110 is shown as having a T-shape, with the top 112 of the T-shape having a first side 114 and a second side 116. The first side 114 includes the anchor 118 which is adapted to receive ball joint 224*b* of the second support strut 218*b*. The second side 116 includes the anchor 120 which is adapted to receive ball joint 224*a* of the first support strut 218*a*.

Optionally, the first and second parallel strut supports 218*a* and 218*b* are adjustable in length by rotating the strut. FIG. 1A shows parallel strut threaded adjustment joints 228*a* and 228*b* with a jam nut attached at the end of each strut. More particularly, the adjustment joints 228*a* and 228*b* have right hand and left hand threads (not shown) accordingly to allow rotation to increase or decrease the strut length. The strut length adjustment allows the adjustment of the upper lift arm 200 angle in the extended position to achieve perpendicularity with the base 110.

The base 110 also includes a centrally located channel portion 122 which extends between a first end 124 and a second end 126. The channel 122 is disposed between a first sidewall 128 and a second sidewall 130 and is generally sized to receive the lower lift arm 140 between the first and second sidewall when the tower is in the retracted configuration. Receiving holes 132*a* and 132*b* are disposed in the first and second sidewalls 128, 130 respectively, near the second end 126 of the base 110 and are adapted to receive the actuator tail pin 182. The tail end 174 of the actuator 170 includes receiving hole 184 which receives tail pin 182 in order to pivotally connect the tail end of the actuator to a pivot block 136. The pivot block 136 is attached at the second end 126 of the base 110 and is included as part of an adjustment mechanism 138 also attached at the second end of the base. The adjustment mechanism 138 is adapted to adjust the desired angle of the actuator 170 with respect to the base 110 and lower lift arm 140. Actuator angle adjustment could alternatively be achieved with an adjustable clevis or similar device attached to the end 176 of the actuator 170. Receiving holes 132*c* and 132*d* are also disposed in the first and second sidewalls 128, 130 respectively, and are located near the first end 124 of the base 110. Receiving holes 132*c* and 132*d* are adapted to receive the strut pin assembly 160 which pivotally connects the lower lift arm 140 to the base 110.

The base 110 further includes one or more spring elements 134 centrally disposed within the channel 122 between first and second sidewalls 128, 130. The spring element 134 is attached to the channel 122 at a location which is generally between the first end 124 and receiving holes 132*c* and 132*d*, such that when the tower is in the fully extended vertical configuration shown in FIGS. 6A and 6B, the foot portion 166 of the flange 152 on the lower lift tower 140 abuttingly engages the one or more spring elements. In this regard, the joint or hinge created by the strut pin assembly 160, which pivotally connects the lower lift arm 140 to the base 110, is considered a pre-loaded joint or hinge vis-à-vis the compression of the spring element 134 by the foot 166. The use of one or more spring elements 134 to provide a pre-loaded joint advantageously removes play and movement of the lower lift arm 140 as the actuator moves the lower lift arm from its retracted configuration to its extended configuration, thereby increasing the stability of the tower compared with existing folding towers.

Figure 3A:
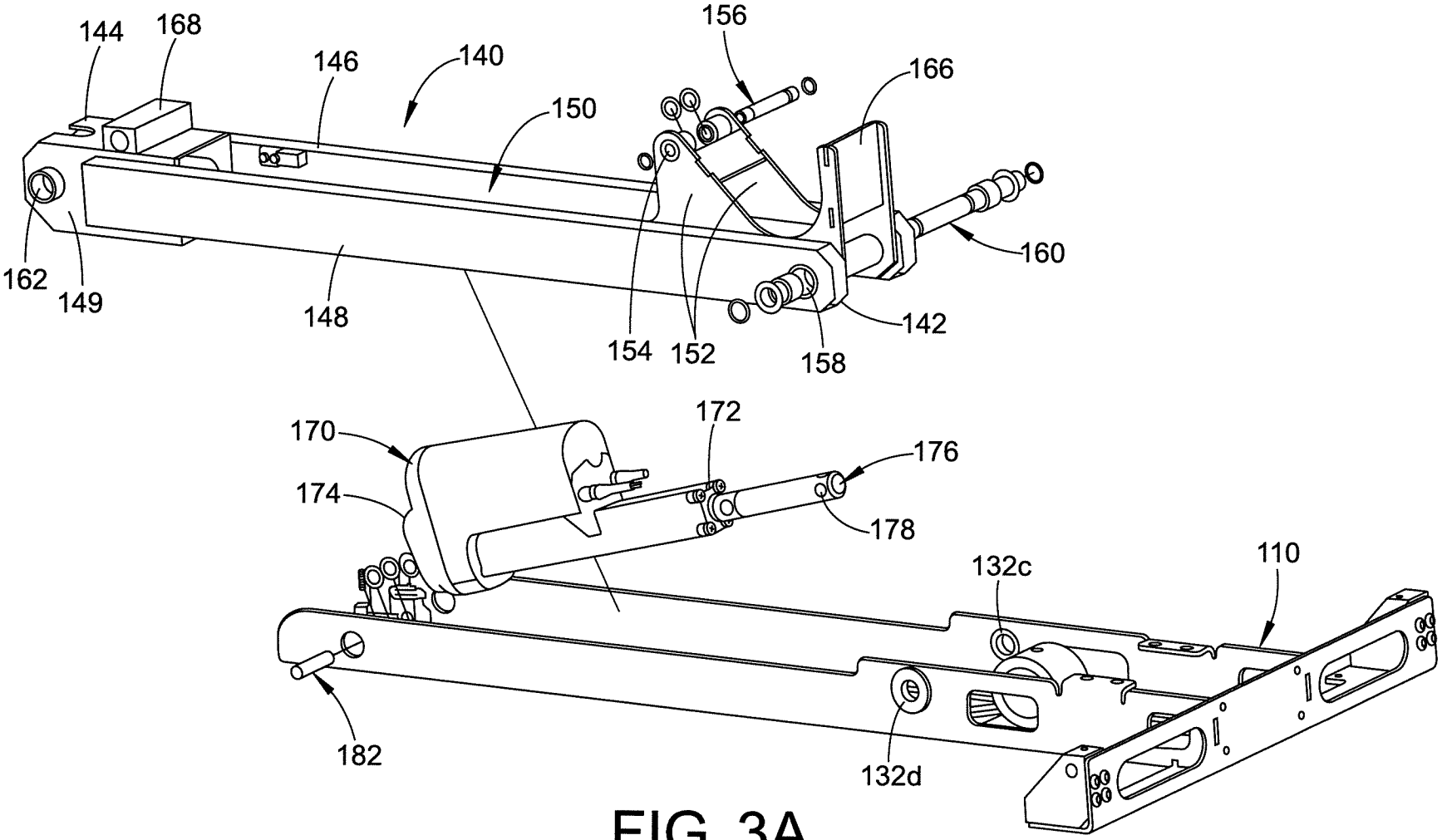
FIG. 3A is a first exploded perspective view of the base illustrated in FIG. 2A and a lower lifting arm in accordance with the present disclosure.
Figure 3B:
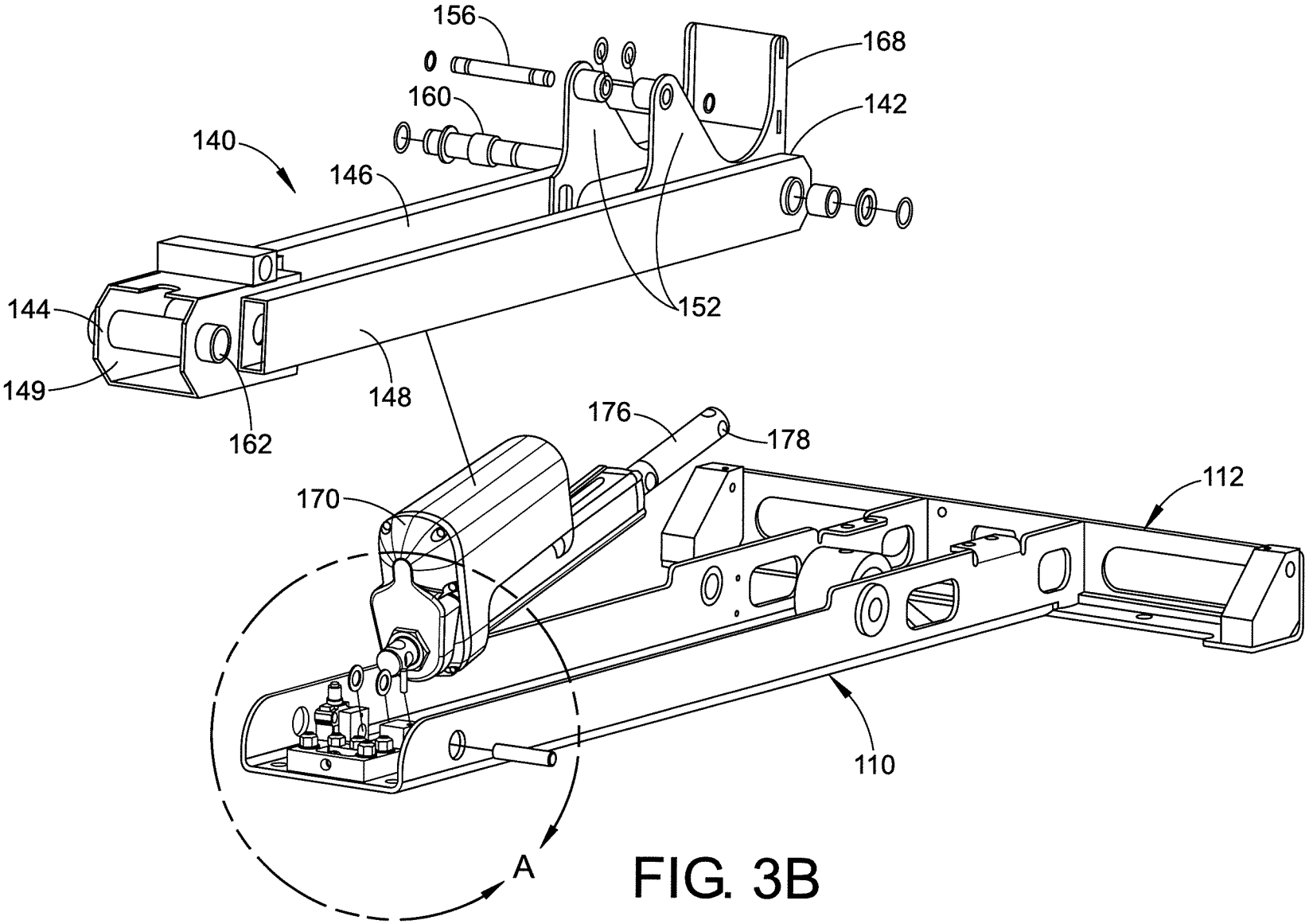
FIG. 3B is a second exploded perspective view of the base and lower lifting arm.
Figure 3C:
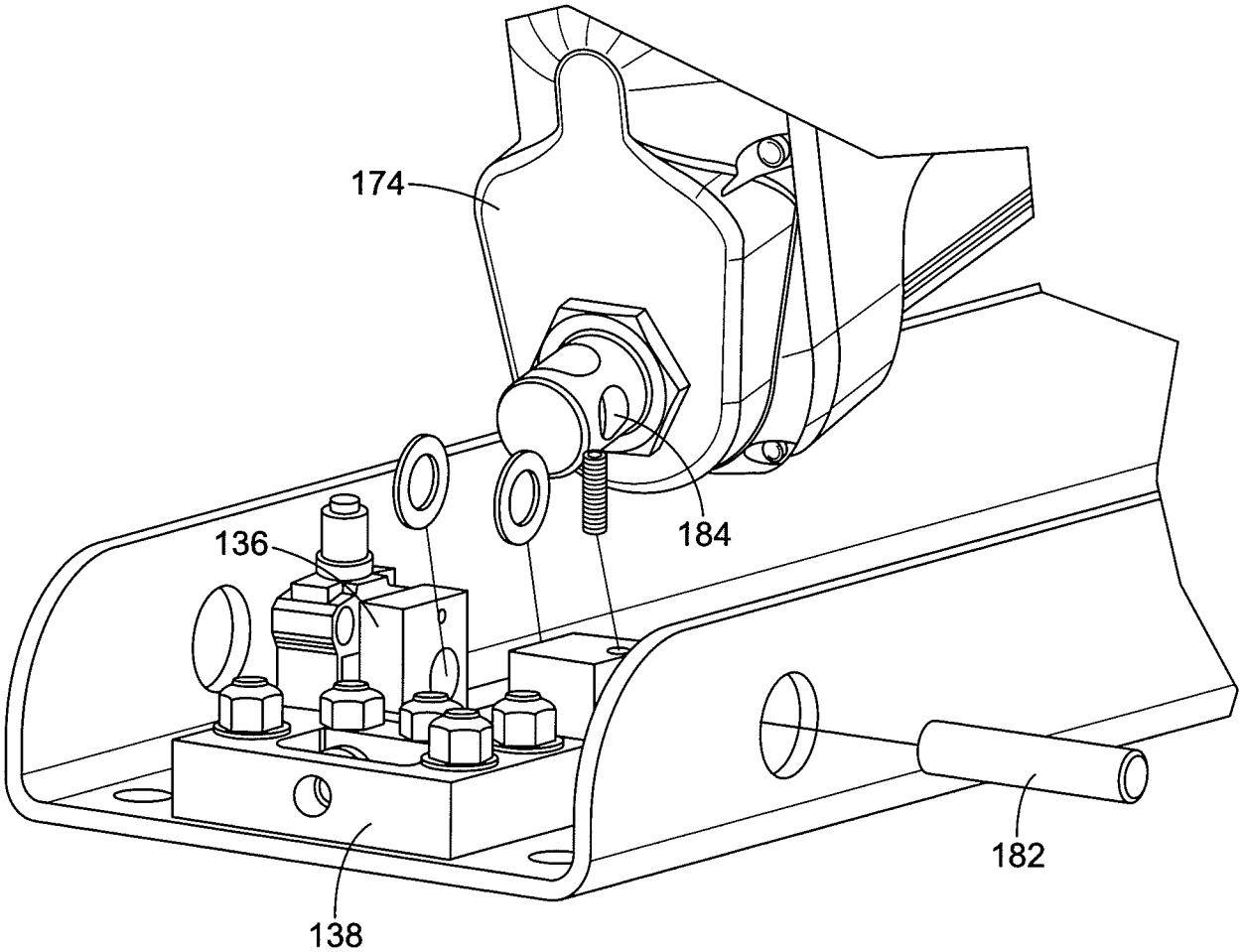
FIG. 3C is a perspective view of one end of the base and lower lifting arm showing additional detail of a connection arrangement between an actuator and the pivot block illustrated in FIG. 2B.

Additional features of the lower lift arm 140 as shown in FIGS. 3A-3C include a first end 142, a second end 144, a first side arm 146, and a second side arm 148. The first and second side arms 146, 148 are attached to external sides of a second end pivot block 149 and the flange portion 152 to define an open middle section 150. The actuator 170 is generally disposed in the open middle section 150. As particularly shown in FIG. 3B, the side arms 146, 148 are hollow tubes or channels which provide internal passages for simple internal wiring of an associated light box or other device. The flange portion 152, foot 166, and receiving hole 158 for lower strut pin assembly 160 are generally disposed near the first end 142 of the lower lift arm 140. The flange portion 152 includes a receiving hole 154 for receiving the actuator pin assembly 156. The strut pin receiving hole 158 is positioned below and behind (i.e., toward first end 142) the actuator pin receiving hole 154 and is disposed through first and second side arms 146, 148 and foot 166. The actuator pin receiving hole 154 is positioned above and in front of (i.e., toward second end 144) the strut pin receiving hole 158 and is disposed through the sides of the elevated portion of flange 152. The front end 172 of the actuator generally includes the cylinder or piston 176, which includes a hole 178 to receive the actuator pin assembly 156 and thereby pivotally connect the front end of the actuator to the flange 152 of the lower lift arm 140.

The second end 144 of the lower lift arm 140 generally includes the pivot block 149, which has a receiving hole 162 to receive a strut pin assembly (164 in FIG. 4) for pivotally connecting the lower lift arm to lower receiving holes 193 on the knuckle 188. This pivotal connection is also shown as joint A in the 4-bar linkage mechanism 190. The pivot block 149 on the second end 144 also includes a pin block 168 to receive a link pin assembly (192 in FIG. 4) for pivotally connecting the lift links 194*a*, 194*b* to the lower lift arm. This pivotal connection is also shown as joint D in the 4-bar linkage mechanism 190. The pin block 168 is positioned above and behind (i.e., toward first end 142) the receiving hole 162 and is disposed on an upper surface of the pivot block 149. The receiving hole 162 is positioned below and in front of (i.e., toward second end 144) the pin block 168 and is disposed through the side of the pivot block 149.

Figure 4:
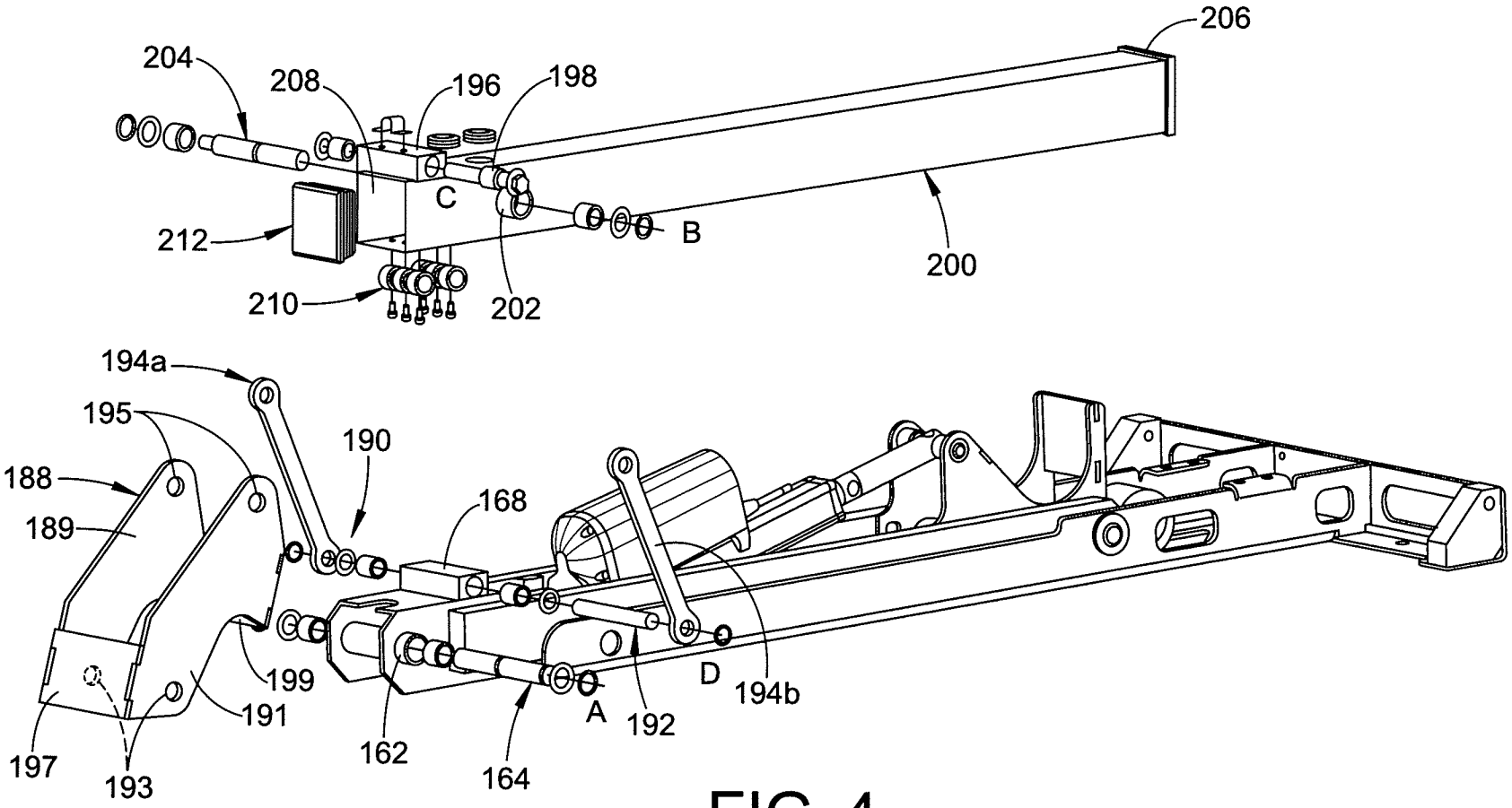
FIG. 4 is an exploded perspective view showing the base and lower lifting arm in FIG. 3A in an assembled configuration along with a 4-bar linkage mechanism and an upper lift arm in accordance with the present disclosure.

Referring now to FIG. 4, additional details of the 4-bar linkage mechanism 190 and the upper lift arm 200 are illustrated. The upper lift arm 200 is a rectangular tube or channel member having a first end 206 and a second end 208. The hollow internal portion of the upper lift arm 200 provides an internal passage for internal wiring, which may be continued from the hollow arm members 146 and 148 of the lower lift arm 140 and connected to a light box (216 in FIG. 1A). The first end 206 of the upper lift arm 200 is adapted to mount the light box 216 thereto.

At the second end 208 of the upper lift arm 200, hole 202 is adapted to receive strut pin assembly 204 and thereby pivotally connect the upper lift arm to upper receiving holes 195 on the knuckle 188. This pivotal connection is also shown as joint B in the 4-bar linkage mechanism 190. The second end 208 also includes a pin block 196 to receive link pin assembly 198 for pivotally connecting the lift links 194*a*, 194*b* to the upper lift arm 200. This pivotal connection is also shown as joint C in the 4-bar linkage mechanism 190. The pin block 196 is positioned above and in front of (i.e., toward second end 208) the receiving hole 202 and is disposed on an upper surface of the upper lift arm 200. The receiving hole 202 is positioned below and behind (i.e., toward first end 206) the pin block 168 and is disposed through the side of the upper lift arm 200.

The upper lift arm 200 further includes one or more spring elements 210 at the second end 208 which are attached to a lower surface of the upper lift arm that is generally opposite to the upper surface on which the pin block 196 is located. When the tower is in the fully extended vertical configuration shown in FIGS. 6A and 6B, the one or more spring elements 210 abuttingly engage an upper bridge wall 199 on the knuckle 188. In this regard, the joints or hinges created by the upper strut pin 204 and the upper link pin 198, which pivotally connect the upper lift arm 200 to the lower lift arm 140 and the knuckle 188, respectively, are considered to be a pre-loaded joint or hinge vis-à-vis the compression of the one or more spring element 210 by the upper bridge wall 199. The use of the one or more spring elements 210 to provide pre-loaded joints advantageously removes play and movement of the upper lift arm 200 as the 4-bar linkage mechanism 190 moves the upper lift arm from its retracted configuration to its extended configuration, thereby increasing the stability of the tower compared with existing folding towers. An end cap 212 is provided at the second end 208 and is adapted to fit within the internal passage of the hollow tube portion of the upper lift arm 200. In this regard, the end cap 212 acts as a seal to protect any internal wiring which may be located within the internal passage of the upper lift arm 200.

The knuckle 188 also includes a lower bridge wall 197 which, together with the upper bridge wall 199, connect both sidewalls 189 and 191 of the knuckle together. The lower and upper bridge walls 197, 199 are generally disposed along parallel planes, but are positioned at different locations on the knuckle 188. In particular, bridge wall 197 is positioned near the lower receiving holes 193 and bridge wall 199 is positioned near the upper receiving holes 195. In addition to connecting sidewalls 189, 191, the lower and upper bridge walls 197, 199 are also adapted to prevent over-rotation of the tower. Over-rotation may occur, for example, when the tower is moving from its retracted configuration to its extended vertical configuration or from external forces during use of the tower, such as wind.

Figure 7:
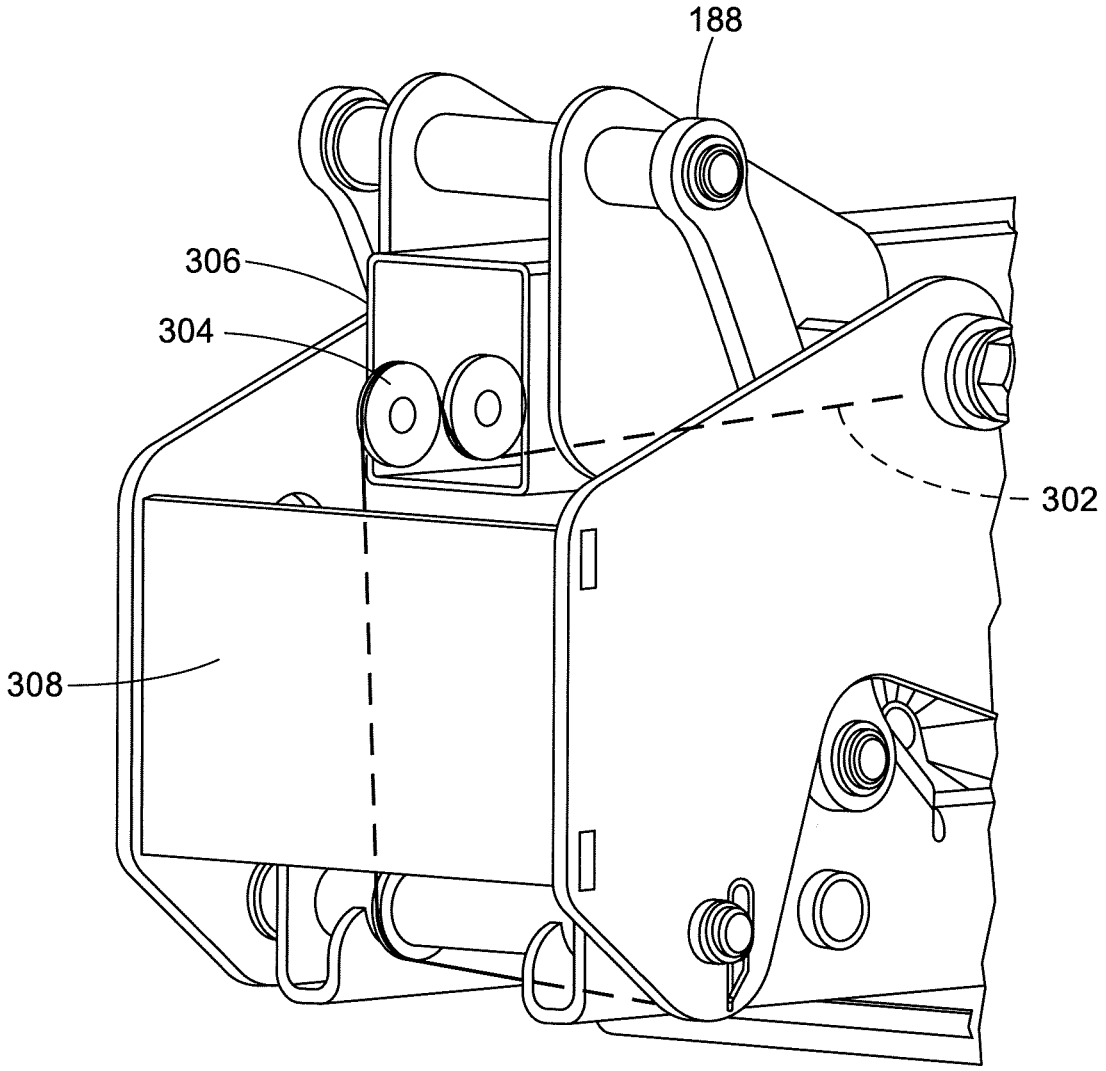
FIG. 7 is a perspective view of an alternative embodiment of the 4-bar linkage mechanism in accordance with the present disclosure.
Figure 8A:
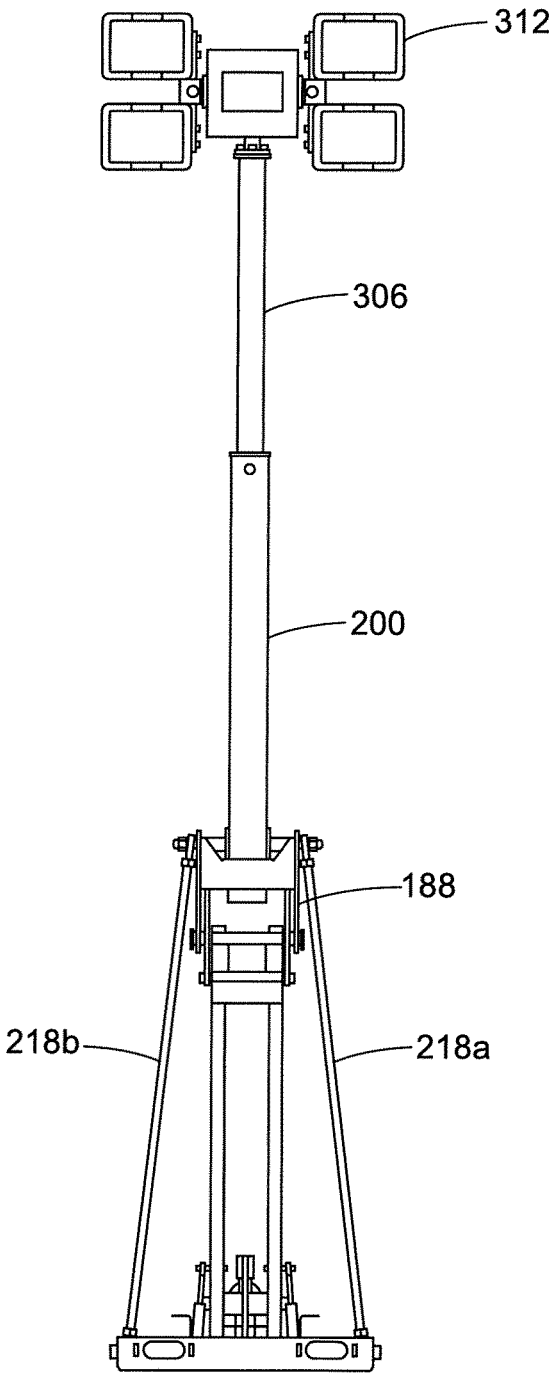
FIG. 8A is a perspective view of an alternative embodiment of the folding tower light assembly in a fully extended vertical configuration in accordance with the present disclosure.
Figure 8B:
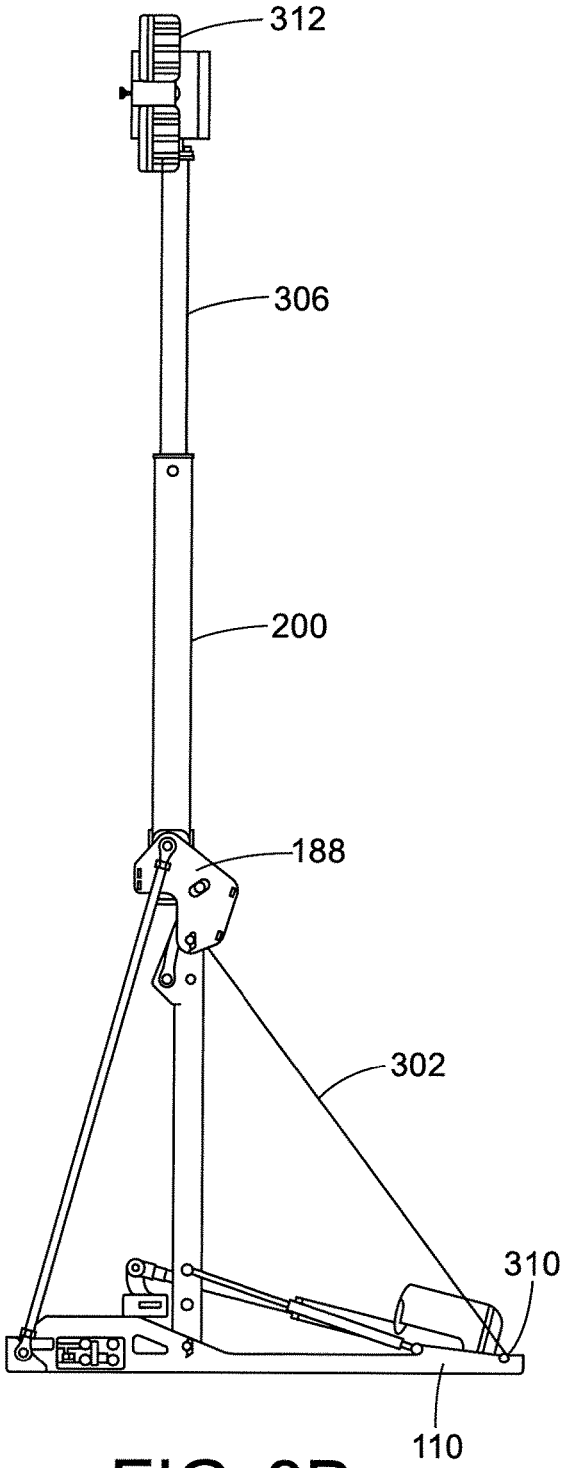
FIG. 8B is a side elevation view of the folding tower light assembly of FIG. 8A.

The 4-bar linkage knuckle 188 typically travels away from the stationary base 110 during deployment. Therefore, optionally, one end of a mechanical cable 302 is attached, through pulleys 304, to a second (or multiple) square tube 306 telescoped inside the upper element tube 200. See FIGS. 7, 8A, 8B. The other end of the mechanical cable 302 is attached to the base 110. The cable 302 runs behind the name plate 308. The cable 302 is routed through the knuckle 188 to the base attachment point 310. The cable 302 runs between tubes 306 to an additional pulley (not shown) at the top of the outer tube 200. The cable 302 then runs back down between the tubes to a fixed point at the bottom of the inner tube 306. This forces the inner tube 306 to extend as the knuckle 188 pulls away from the base 110. Relative motion between the 4-bar linkage and the base would cause the new inner tube(s) 306 to extend upward from the upper tube 200 during deployment. The new tube(s) 306 would then be retracted by, for example, a mechanical spring (not shown) attaching the new tube(s) to the existing tube 200. The advantage of this approach is to achieve a higher elevated height for the payload 312 in the same mechanical footprint as the existing mechanism. The payload 312 is attached to the new tube(s) 306. Otherwise, the footprint would need to be enlarged to achieve higher elevated heights. Further, the base footprint does not change to add the telescoping tube feature. For example, this approach allows a 2.0 meters tall mast to extend to 2.65 meters in the same footprint. While this embodiment is described with one telescoping tube, multiple tubes could be telescoped and cable driven to reach higher heights.

Referring back to FIG. 1C, the upper lift arm 200 has an overall length $L_u$, as measured between its first and second ends 206, 208, and a width $W_u$. Joint B of the 4-bar linkage mechanism 190 is spaced a distance $D_B$ from the first end 206 of the upper lift arm which is less than the overall length $L_u$. In the retracted configuration, the actuator 170 extends over a length $L_a$ that is less than lengths $L_u$ and $D_B$. In some specific embodiments, overall length $L_u$ is about 40 inches, the distance $D_B$ of joint B is about 34 inches, and the length $L_a$ of the actuator is about 25 inches. Moreover, when in the contracted configuration as illustrated in FIG. 1A, the 4-bar linkage mechanism 190 defines a height H. In particular embodiments, the height H is about 12 inches. However, it should be understood that the aforementioned components of the exemplary folding tower can have any desired dimensions without departing from the scope of the present disclosure.

The components of the exemplary folding tower light described herein, including but not limited to the main components of a base 110, a lower lift arm 140, a linear actuator 170, a 4-bar linkage mechanism 190, an upper lift arm 200, a light box 216 including one or more lights, and first and second parallel support struts 218*a* and 218*b*, can be made from any suitable material known to those having skill in the art. For example, the various components of the exemplary folding light tower can be made from any material providing adequate structural strength, durability, reliability, etc. that may be desired. Such materials may include but are not limited to metals, alloys, plastics and other polymers, wood, etc.

The exemplary folding light tower described herein advantageously utilizes a 4-bar linkage mechanism to achieve a fully extended vertical configuration of the lower and upper lift arms, as opposed to using two actuators as commonly practiced in existing systems. The 4-bar linkage is comparatively easier and more inexpensive to manufacture than an actuator, resulting in an overall application that is more inexpensive than existing tower light systems. Furthermore, the 4-bar linkage achieves a faster deployment time compared with prior designs that rely on the use of two actuators, which benefits applications that are time sensitive. Additionally, the 4-bar linkage is purely mechanical, which eliminates the risk of leaks from additional actuators.

Moreover, the use of pre-loaded spring joints enables greater stability compared with known light towers, which benefits certain applications such as surveillance. In addition, all of the hinges or joints in the exemplary folding tower are rotational as opposed to sliding, enabling a simplified power-up power-down operation that is more tolerant of complications from ice or other contaminants.

Further, it is to be appreciated that the present exemplary embodiment is also amenable to other like applications, such as for raising antennas, surveillance equipment, and other payloads.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A folding tower system for raising a light source, comprising:

a stationary base having a first end and a second end;

a lower lift arm having a first end and a second end, the first end of the lower lift arm being connected to the base;

an actuator attached to the base and the lower lift arm;

an upper lift arm having a first end and a second end, the first end being adapted to mount the light source thereon; and, a 4-bar linkage mechanism connecting the second end of the lower lift arm to the second end of the upper lift arm in rotational relation to one another, wherein the folding tower system further comprises one or more support struts rotationally connected to the base and the upper lift arm, wherein the one or more support struts comprises a first support strut and a second support strut disposed on opposite sides of the folding tower system, wherein the first support strut has a first ball joint rotationally connected to one side of the base and a second ball joint rotationally connected to one side of the upper lift arm on the 4-bar linkage mechanism and the second support strut has a first ball joint rotationally connected to an opposite side of the base and a second ball joint rotationally connected to an opposite side of the upper lift arm on the 4-bar linkage mechanism.

2. The folding tower system of claim 1, further comprising a pin assembly pivotally connected the stationary base and the lower lift arm.

3. The folding tower system of claim 1, wherein one end of the actuator is attached to the base and another end of the actuator is pivotally connected to the lower lift arm.

4. The folding tower system of claim 3, further comprising an adjustment mechanism adapted to adjust an angle of the actuator with respect to the base and the lower lift arm.

5. The folding tower system of claim 1, wherein the stationary base and the lower and upper lift arms are disposed horizontally parallel to each other when in a retracted configuration.

6. The folding tower system of claim 1, wherein the lower and upper lift arms are disposed vertically perpendicular to the base when in a vertical extended configuration.

7. The folding tower system of claim 1, wherein the 4-bar linkage mechanism comprises at least one lift link and a knuckle rotationally connected to the lower and upper lift arms.

8. The folding tower system of claim 7, wherein the knuckle further comprises a first sidewall and a second sidewall.

9. The folding tower system of claim 8, wherein the first and second sidewall are connected by an upper bridge wall and a lower bridge wall, the upper and lower bridge walls adapted to prevent an over-rotation of the folding tower system.

10. The folding tower system of claim 1, further comprising one or more spring elements attached to the base to provide a pre-loaded joint between the base and the lower lift arm.

11. The folding tower system of claim 1, further comprising one or more spring elements attached to the upper lift arm to provide a pre-loaded joint between the upper lift arm and the 4-bar linkage mechanism.

12. The folding tower system of claim 1, further comprising a light box mounted to the upper lift arm.

13. The folding tower system of claim 1, further comprising a first support strut rotationally connected to one side of the base and upper lift arm and a second support strut rotationally connected to an opposite side of the base and upper lift arm.

14. A folding tower system for raising a light source, comprising:

a stationary base having a first end and a second end;

a lower lift arm having a first end and a second end, the first end of the lower lift arm being connected to the base;

an actuator attached to the base and the lower lift arm;

an upper lift arm having a first end and a second end, the first end being adapted to mount the light source thereon; and, a 4-bar linkage mechanism connecting the second end of the lower lift arm to the second end of the upper lift arm in rotational relation to one another, wherein the folding tower system further comprises a mechanical cable, wherein one end of the mechanical cable is attached through pulleys to a second square tube telescoped inside the upper lift arm and the other end of the mechanical cable attached to the stationary base and wherein the second square tube is configured to extend as the 4-bar linkage mechanism pulls away from the base.

15. A folding tower system for raising a light source, comprising:

a stationary base having a first end and a second end;

a lower lift arm having a first end and a second end, the first end of the lower lift arm being connected to the base;

an actuator attached to the base and the lower lift arm, wherein one end of the actuator is attached to the base and another end of the actuator is pivotally connected to the lower lift arm;

an upper lift arm having a first end and a second end, the first end being adapted to mount the light source thereon;

a 4-bar linkage mechanism connecting the second end of the lower lift arm to the second end of the upper lift arm in rotational relation to one another;

an adjustment mechanism adapted to adjust an angle of the actuator with respect to the base and the lower lift arm;

at least two support struts rotationally connected to the base and the upper lift arm, wherein the at least two support struts comprises a first support strut and a second support strut disposed on opposite sides of the folding tower system;

one or more spring elements attached to the upper lift arm to provide a pre-loaded joint between the upper lift arm and the 4-bar linkage mechanism.

16. A method of raising a light source, comprising:

providing a folding tower system which includes a stationary base, a lower lift arm, an actuator, an upper lift arm, a light box mounted to the upper lift arm, and a 4-bar linkage mechanism rotationally connecting the lower lift arm and the upper lift arm;

applying a force to the lower arm with the actuator and rotating the lower arm into a vertical extended configuration with respect to the base; and, rotating the upper lift arm into the vertical extended configuration with the 4-bar linkage mechanism, wherein the method further comprises raising the lower and upper lift arms from a retracted configuration into the vertical extended configuration, wherein the base and the lower and upper lift arms are disposed horizontally parallel to each other when in the retracted configuration and wherein the lower and upper lift arms are disposed perpendicular to the base when in the vertical extended configuration, and wherein the actuator applies a linear force to the lower lift arm and the rotating of the upper lift arm further comprises translating the linear force into angular rotation.

* * * * *